US010156426B2

(12) United States Patent
Halter

(10) Patent No.: US 10,156,426 B2
(45) Date of Patent: Dec. 18, 2018

(54) APPARATUS AND METHODS FOR PARALLEL TESTING OF DEVICES

(71) Applicant: The United States of America as represented by the Secretary of the Navy, Washington, DC (US)

(72) Inventor: Mark Halter, Washington, IN (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 291 days.

(21) Appl. No.: 15/188,497

(22) Filed: Jun. 21, 2016

(65) Prior Publication Data

US 2017/0363392 A1 Dec. 21, 2017

(51) Int. Cl.
*G01L 5/14* (2006.01)
*F41G 7/00* (2006.01)

(52) U.S. Cl.
CPC ..... *F41G 7/001* (2013.01)

(58) Field of Classification Search
CPC ..... F41G 7/001
USPC ..... 73/167
See application file for complete search history.

(56) References Cited

U.S. PATENT DOCUMENTS 5,579,218 A 11/1996 Ehlig et al.
5,721,680 A 2/1998 Van Cleve et al.
6,945,780 B2 9/2005 Perry
7,043,343 B1 5/2006 Houlberg et al.
7,183,970 B1 2/2007 Houlberg et al.
7,280,954 B2 10/2007 Belenger et al.
8,726,203 B1 5/2014 Uckum et al.
8,762,784 B1 6/2014 Portal et al.
8,826,084 B1 9/2014 Gauf et al.
(Continued)

FOREIGN PATENT DOCUMENTS

EP 2618099 7/2013

OTHER PUBLICATIONS

Anderson Jr., J.L., "High Performance Missile Testing (Next Generation Test Systems)"; published 2003; available online at http://ieeexplore.ieee.org/stamp/stamp.jsp?arnumber=1243549; 9 pages.
(Continued)

*Primary Examiner* — Lisa Caputo
*Assistant Examiner* — Roger Hernandez-Prewit
(74) *Attorney, Agent, or Firm* — Christopher A. Monsey

(57) ABSTRACT

Test systems coupled to a device under test (DUT) with different segments or stages and related methods are provided. Exemplary test systems include logic that executes concurrent determinations or tests for multiple DUT segments or stages. Exemplary test systems can include logic that concurrently executes various tests associated with different DUT segments including determinations or testing for a specified DUT test environment, determinations or tests of when data will be made available to various DUT segments, and various determinations or tests that may be completed before data is made available to specified DUT segments. At least one embodiment of a first stage concurrent determination test system determines first stage tests do not require a specified target and high pressure gas conditions for DUT testing and at least one embodiment of a second stage concurrent test system does require a specified target and high pressure gas conditions for DUT testing.

30 Claims, 7 Drawing Sheets

(56) References Cited

U.S. PATENT DOCUMENTS

| | | | | |
|---|---|---|---|---|
| 9,015,544 | B2 | 4/2015 | Whetsel | |
| 2003/0105989 | A1 | 6/2003 | Saunders | |
| 2012/0191400 | A1* | 7/2012 | Sontakke et al. | G01R 31/31724 702/119 |
| 2014/0253142 | A1* | 9/2014 | Fink et al. | G01R 31/016 324/538 |

OTHER PUBLICATIONS

Xiao-Ping, Zhu et al., "The TPS Development of Parallel Automatic Test Systems"; published 2004, IEEE Autotestcon; available online at http://ieeexplore.ieee.org/stamp/stamp.jsp?arnumber=1436842; 6 pages.

* cited by examiner

APPARATUS AND METHODS FOR PARALLEL TESTING OF DEVICES

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 102,280) is assigned to the United States Government and is available for licensing for commercial purposes. Licensing and technical inquiries may be directed to the Technology Transfer Office, Naval Surface Warfare Center Crane, email: Crane_CTO@navy.mil.

FIELD OF THE DISCLOSURE

The invention relates generally to apparatus and methods for the testing of devices and, more specifically, to computer assisted device testing.

BACKGROUND

A device often has to undergo a variety of tests before that device is deemed ready for use. For example, a device (e.g., unit) may be required to pass a number of tests at a manufacturing plant before that device is allowed to be shipped for use. As such, testing systems, which operate to test devices, may execute a plurality of tests on a device to ensure its operability. Many of these testing systems are required to run more than one test on each device. As such, the testing systems may run one test and, depending on the outcome of the first test, may run a second test. For example, if the first test passes successfully, the testing system may run the second test. If, however, the first test does not pass successfully, the testing system may not run the second test. Some of these testing systems include one or more processors executing software instructions to carry out the various tests.

The software, however, is often written such that tests are executed sequentially until all tests are completed. For example, software may be written in such a manner that a first test is executed, and upon its completion a second test is executed. Similarly, upon completion of the second test, a third test may be executed, and so on. In this manner, the amount of time that it takes to execute a series of tests becomes the sum of the amount of time it takes to execute each test. The amount of time required to test devices is further affected by the number of devices needing to be tested. For example, for each additional device that needs to be tested, the total testing time increases by the amount of time that it takes to execute the series of tests on each device. Moreover, the running of one test may conflict with the running of another test. For example, one test may need another test to complete before the first test may be run. As another example, one test may need the device under test to be in one mode, while another test may need the device to be in a different mode. As such, a device under test may need to be placed in a particular mode for running a particular test.

The testing of missiles is no exception. Missiles must undergo a variety of tests before they are deemed available for use. For example, missiles include various subsystems that must each be tested. The testing of these subsystems may include the measuring of voltage levels, audio signal levels, gas flow rates, among other examples. As such, the testing of missiles can be a very time consuming process. Therefore, there are opportunities to reduce the amount of testing time for missiles and other devices.

SUMMARY OF THE DISCLOSURE

Apparatus and methods have been developed that reduce the amount of time it takes to test devices such as missiles. The apparatus and methods may execute tests or portions of tests in a parallel manner. The apparatus and methods ensure that tests or portions of tests executing in parallel do not interfere with one another. For example, the apparatus and methods may ensure that the output of one test is not needed by another test that is run in parallel. The apparatus and methods may quantify test time and allow one or more tests to advance a limited number of "steps" in that time. For example, the apparatus and methods may specify when a particular test may execute. For example, the apparatus and methods may allow a particular test to be performed only between 10 and 20 seconds after application of power. The apparatus and methods may also assess the current state of a test environment to confirm whether it is acceptable to advance one or more tests. For example, if the testing environment is not acceptable for a test to continue executing, the apparatus and methods do not allow the test to advance. The testing environment may be monitored by measuring one or more "vital signs", where the vital signs may indicate whether it is safe for a particular test to advance. Vital signs that may be measured when testing missiles may include, for example, supply voltage, current draw, gyro spin frequencies, and target acquisition signal amplitudes.

The apparatus and methods may monitor the testing environment by anticipating when a next set of data, such as data representing a vital sign, will be made available. If the apparatus and methods determine that a data set will be made available before a next step in the testing process may be completed, the apparatus and methods will not execute the next step in the testing process (e.g., pause the testing process) until after it received the next data set. For example, if the apparatus and methods anticipate new data to arrive in 0.1 seconds and anticipates the next step in the testing process to take 0.15 seconds, it will suspend the testing process until after the new data has been received. As such, the apparatus and methods provide an efficient way to test devices, such as missiles, thereby reducing testing times.

In one embodiment, a test system includes a test device, such as a test missile, which is a device under test, and an electronic device. The electronic device may be a personal computer, a server, a laptop, a tablet, a processing device, or any other suitable electronic device. The electronic device may be operatively coupled to the test device. For example, the electronic device may be configured to receive or provide signals, such as analog signals, digital signals (e.g., binary signals indicating "high" or "low" voltage), control signals, or other signals from or to the test device. In one example, the electronic device is operatively coupled to test equipment, where the test equipment is configured to receive signals from, and provide signals to, the test device. In this example, the electronic device may read signals from the test device via the test equipment. For example, the test equipment may receive signals from the test device and provide an indication of their levels to the electronic device. Similarly, the electronic device may cause the test equipment to provide signals to the test device. For example, the electronic device may be operable to provide a signal or message to the test equipment to provide one or more signals to the test device.

In one example, the test device is a test missile. The testing of the test missile may include one or more tests that require a missile target. For example, the testing may include testing the missile's target tracking capability, and as such the test may require a simulated target for the test missile to track. Moreover, various tests may require different types of targets. For example, a missile may be operable to track more than one type of target. Types of targets may be based on the size or intensity (e.g., brightness) of the target. For example, one missile type may be brighter than a second missile type. Similarly, one missile target type may be larger than another missile type. As another example, a missile may have different current draws depending on the type of missile target type being tracked. Thus, while some tests may require a first type missile target, other tests may require a second type missile target. The testing of the test missile may also include one or more tests that require high pressure gas. For example, the test missile may include one or more subsystems that require a flow of high pressure gas. The electronic device may be operable to cause high pressure gas to be turned on or off within the test missile via, for example, a control signal.

In one example, the electronic device determines that one or more first stage tests to be executed on a test missile do not require a missile target or high pressure gas for testing of the test missile. The electronic device may then concurrently execute, or cause to execute, the first stage tests on the test missile by determining when data will be made available for each of the plurality of first stage tests and executing a portion of the plurality of first stage tests that may be completed before the data is made available for each of the plurality of first stage tests. The electronic device may then provide an indication of whether one or more of the first stage tests completed successfully or failed. For example, the electronic device may display an indication of whether the first stage tests completed successfully. In another example, the electronic device may store an indication of whether one or more of the first stage tests completed successfully, or failed, into a database that may be accessible via a network, such as the Internet, by other electronic devices.

In one example, the first stage tests include a gyro spin test. To execute the gyro spin test, the electronic device provides the test missile with a test signal. After a minimum threshold amount of time (e.g., 700 milli-seconds), the electronic device may receive (e.g., read) a signal from the test missile to determine a spin frequency of a gyro (e.g., gyro spin frequency) of the test missile. For example, the electronic device may calculate a gyro spin frequency based on a gyro frequency reading received from the test missile. The electronic device may also determine a gyro spin time of the gyro of the test missile based on one or more received signals from the missile. The gyro spin time is the time it takes the gyro to reach a specific spin frequency after a particular event, such as application of power. The electronic device may then determine whether the gyro spin frequency is within a certain range (gyro spin frequency range). Similarly, the electronic device may determine whether the gyro spin time falls within a certain range (gyro spin time range). If the determined gyro spin frequency is within the gyro spin frequency range, the electronic device may provide an indication that the gyro spin test completed successfully. In one embodiment, the electronic device may provide the indication that the gyro spin test completed successfully when the gyro spin time falls within a gyro spin time range. If, however, the determined gyro spin frequency is not within the gyro spin frequency range, the electronic device may provide an indication that the gyro spin test has failed.

In another example, the first stage tests include a gyro spin frequency test. To execute the gyro spin frequency test, the electronic device determines a gyro spin frequency of a gyro of the test missile based on one or more received signals from the missile after a minimum threshold amount of time (e.g., 8 milli-seconds). For example, the gyro spin frequency test may determine whether a gyro is spinning at a desirable frequency after an amount of time has elapsed since a particular event, such as the application of power. The gyro spin frequency may be a current spin frequency of the gyro. The electronic device may then determine whether the determined gyro spin frequency is within a gyro spin frequency range. If the determined gyro spin frequency is within the gyro spin frequency range, the electronic device may provide an indication that the gyro spin test is successful. Otherwise, the electronic device may determine may provide an indication that the gyro spin test failed. In one example, the first stage tests may also include a gyro spin direction test where the electronic device determines the spin direction of the gyro based on one or more received signals from the test missile. The electronic device may then provide an indication of the gyro's spin direction.

In one embodiment, the first stage tests include a digital word sensing test. The digital word sensing test may test whether data is being successfully transmitted between the missile and a controller, such as a controller to a launcher that launches a missile. To execute the digital word sensing test, the electronic device determines (e.g., reads) the occurrence (e.g., presence) of a digital word in signal based on one or more received signals from the test missile after a minimum threshold amount of time. Similarly, the electronic device may determine a digital word out signal based on one or more received signals from the test missile after a minimum threshold amount of time. The minimum thresholds amount of time before determining the digital word in and digital word out values may be the same or different. The electronic device may then determine whether the digital word in signal occurred, and whether the digital word out signal occurred. If the electronic device determines that both the digital word in signal occurred and the digital word out signal occurred, the electronic device provides an indication that the digital word sensing test completed successfully. Otherwise, the electronic device may provide an indication that the digital word sensing test failed.

In another example, the electronic device may determine whether a digital word in value (e.g., a value based on the received digital word in signal) matches an expected digital word in value. The electronic device may also determine whether the digital word in value matched the expected digital word in value within a certain time range (digital word in time range). Similarly, the electronic device may determine whether the digital word out value matches an expected digital word out value. The electronic device may also determine whether the digital word out value matched the expected digital word out value within a certain time range (digital word out time range). In one example, if the digital word in value matches the expected digital word in value, the digital word in time is within the digital word in time range, the digital word out matches the expected digital word out, and the digital word out time is within the digital word out time range, the electronic device provides an indication that the digital word sensing test completed successfully. Otherwise, the electronic device may provide an indication that the digital word sensing test failed.

In one embodiment, the first stage tests include a chirp test. To execute the chirp test, the electronic device determines an audio out signal level on a received audio out signal from the missile after a minimum threshold amount of time. The electronic device may monitor the audio out signal level over a period of time, up to a maximum threshold amount of time (e.g., time limit). For example, the electronic device may monitor the audio out signal level periodically (7 times per second) from the minimum threshold amount of time up until the maximum threshold amount limit. The electronic device may then determine the number of times the measured audio out signal level does not fall within an audio out signal level range during the period of time. For example, the electronic device may determine the number of times the audio out signal level exceeded a threshold. If the determined number of times the audio out signal level did not fall within the audio out signal level range exceeds a threshold, the electronic device may provide an indication that the audio out signal level test failed. Otherwise, the electronic device may provide an indication that the audio out signal level test completed successfully.

In one embodiment, the first stage tests include an operating current test. To execute the operating current test, the electronic device determines an operating current based on one or more received signals from the test missile during a specific period of time (e.g., such as after a minimum threshold amount of time but before a maximum threshold amount of time). The electronic device may then determine whether the operating current is within an acceptable operating current range (e.g., an expected operating current range). In one example, if the operating current is within the operating current range, the electronic device provides an indication that the operating current test was successful. Similarly, if the operating current is not within the operating current range, the electronic device provides an indication that the operating current test has failed. In another example, if the operating current is within the operating current range and a certain number of first stage tests have completed successfully, the electronic device provides an indication that the operating current test completed successfully; otherwise, the electronic device provides an indication that the operating current test failed. For example, the electronic device may provide an indication that the operating current test failed if another test has not completed successfully because the test environment were not acceptable to execute the operating current test.

In one embodiment, the electronic device determines that one or more second stage tests to be executed on a test missile require a first type missile target and high pressure gas for testing of the test missile. The electronic device may then concurrently execute, or cause to execute, the second stage tests on the test missile by determining when data will be made available for each of the plurality of second stage tests and executing a portion of the plurality of second stage tests that may be completed before the data is made available for each of the plurality of second stage tests. The electronic device may also provide an indication of whether the one or more of the second stage tests completed successfully or failed.

For example, the second stage tests may include a gas flow rate test. To execute the gas flow rate test, the electronic device determines a gas flow rate based on one or more received signals from the test equipment connected to the test missile after a minimum threshold amount of time. The gas flow rate may be, for example, the rate at which a particular gas is flowing through one or more gas lines from the test equipment, such as a missile launcher, to the test missile. The electronic device may then determine whether the gas flow rate is within a certain (e.g., acceptable) range (e.g., gas flow rate range). If the gas flow rate is within the gas flow rate range, the electronic device may provide an indication that the gas flow rate test completed successfully. If the gas flow rate is not within the gas flow rate range, the electronic device may provide an indication that the gas flow rate test failed.

In one embodiment, the second stage tests include a functional cool down test. To execute the functional cool down test, the electronic device determines whether a test missile acquires tracking of a first type missile target before a maximum threshold amount of time (e.g., 4 seconds) based on one or more received signals from the test missile. For example, the electronic device may initiate the functional cool down test and, before a maximum amount of time has elapsed, may determine whether the test missile acquired tracking of a first type missile target. If the test missile acquires tracking of the first type missile target before the maximum threshold amount of time has elapsed, the electronic device may provide an indication that the functional cool down test completed successfully. If the test missile does not acquire tracking of the first type missile target before the maximum threshold amount of time expires, the electronic device may provide an indication that the functional cool down test failed.

In one embodiment, the second stage tests may also include a tracking sensitivity test. To execute the tracking sensitivity test, the electronic device determines whether the test missile maintains acquisition of the first type missile target for a minimum threshold amount of time based on one or more received signals from the test missile. For example, if the electronic device determines that the functional cool down test was successful, the electronic device may determine whether the test missile maintains acquisition of the first type missile target acquired during the functional cool down test for a minimum threshold amount of time (e.g., 9 seconds). In one example, if the first type missile target has not yet been acquired, the tracking sensitivity test will first acquire the first type missile target before proceeding with determining whether the test missile maintains acquisition of the first type missile target. If the test missile maintains acquisition of the first type missile target for the minimum threshold amount of time, the electronic device may provide an indication that the tracking sensitivity test completed successfully. Otherwise, the electronic device may provide an indication that the tracking sensitivity test failed.

In one embodiment, the electronic device determines that one or more third stage tests to be executed on a test missile require a second type missile target for testing of the test missile. The electronic device may then concurrently execute, or cause to execute, the third stage tests on the test missile by determining when data will be made available for each of the plurality of third stage tests and executing a portion of the plurality of third stage tests that may be completed before the data is made available for each of the plurality of third stage tests. The electronic device may also provide an indication of whether the one or more of the third stage tests completed successfully or failed.

For example, the third stage tests may include a positive quiescent current test. To execute the positive quiescent current test, the electronic device determines a positive quiescent current level of the test missile, based on one or more received signals from the test missile, while the test missile is tracking a second missile type target. For example, the electronic device may initiate the tracking of a second missile type target by the test missile. While the test missile is tracking the second missile type target, the electronic device may query the test missile to determine a positive quiescent current level. The electronic device may also maintain a positive quiescent current range with which to compare a determined positive quiescent current level. If the positive quiescent current level is within the positive quiescent current range, the electronic device may provide an indication that the positive quiescent current test completed successfully. Otherwise, if the positive quiescent current level is not within that range, the electronic device may provide an indication that the positive quiescent current test failed.

In one embodiment, the third stage tests may include a negative quiescent current test. To execute the negative quiescent current test, the electronic device determines a negative quiescent current level of the test missile, based on one or more received signals from the test missile, while the test missile is tracking a second missile type target. While the test missile is tracking the second missile type target, the electronic device may query the test missile to determine a negative quiescent current level. The electronic device may also maintain a negative quiescent current range with which to compare a determined negative quiescent current level. If the negative quiescent current level is within the negative quiescent current range, the electronic device may provide an indication that the negative quiescent current test completed successfully. Otherwise, if the negative quiescent current level is not within that range, the electronic device may provide an indication that the negative quiescent current test failed.

In one embodiment, the third stage tests may include a clockwise tracking capability test. The clockwise tracking test may include the tracking of a missile target type from left to right. To execute the clockwise tracking capability test, the electronic device determines whether the test missile maintains acquisition of the second type missile target, such as to a specific position, based on one or more received signals from the test missile, for a minimum threshold amount of time (e.g., 2-3 seconds). If the test missile maintains acquisition of the second type missile target for the minimum threshold amount of time, the electronic device may provide an indication that the clockwise tracking capability test completed successfully. Otherwise, if the test missile does not maintain acquisition of the second type missile target for the minimum threshold amount of time, the electronic device may provide an indication that the clockwise tracking capability test failed.

In one embodiment, the third stage tests may include a caging capability test. To execute the caging capability test, the electronic device first determines whether the test missile tracks the second type missile target to an off-axis position (e.g., a position that is not directly in front of the test missile (e.g., an axial position)) based on one or more received signals from the test missile, for a minimum threshold amount of time. The electronic device then provides an indication to the test missile to cease tracking and return to an on-axis position. The electronic device then determines whether the test missile has lost acquisition of the second type missile and has returned to an on-axis position. If the electronic device determines that the test missile has lost acquisition of the second type missile and has returned to an on-axis position, the electronic device may provide an indication that the caging capability test completed successfully. Otherwise the electronic device may provide an indication that the caging capability test failed.

In one example, the electronic device determines that one or more first stage tests to be executed on a device under test require a first test environment. For example, in the case of a test missile, the first test environment may not require a missile target or high pressure gas for testing of the test missile. The electronic device may then concurrently execute, or cause to execute, the first stage tests on the device under test by determining when data will be made available for each of the plurality of first stage tests and executing a portion of the plurality of first stage tests that may be completed before the data is made available for each of the plurality of first stage tests. The electronic device may then provide an indication of whether one or more of the first stage tests completed successfully or failed.

In one example the electronic device determines that one or more second stage tests to be executed on the device under test requires a second test environment. For example, the second test environment, in the case of a test missile, may require a first type missile target and high pressure gas for testing of the test missile. The electronic device may then concurrently execute, or cause to execute, the second stage tests on the device under test by determining when data will be made available for each of the plurality of second stage tests and executing a portion of the plurality of second stage tests that may be completed before the data is made available for each of the plurality of second stage tests. The electronic device may also provide an indication of whether the one or more of the second stage tests completed successfully or failed In one embodiment, the electronic device determines that one or more third stage tests to be executed on the device under test require a third test environment. For example, in the case of a test missile, the third test environment may require a second type missile target for testing of the test missile. The electronic device may then concurrently execute, or cause to execute, the third stage tests on the device under test by determining when data will be made available for each of the plurality of third stage tests and executing a portion of the plurality of third stage tests that may be completed before the data is made available for each of the plurality of third stage tests. The electronic device may also provide an indication of whether the one or more of the third stage tests completed successfully or failed.

As such, the apparatus and methods provide an efficient way to test devices, such as missiles, thereby reducing testing times. Additional features and advantages of the present invention will become apparent to those skilled in the art upon consideration of the following detailed description of the illustrative embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
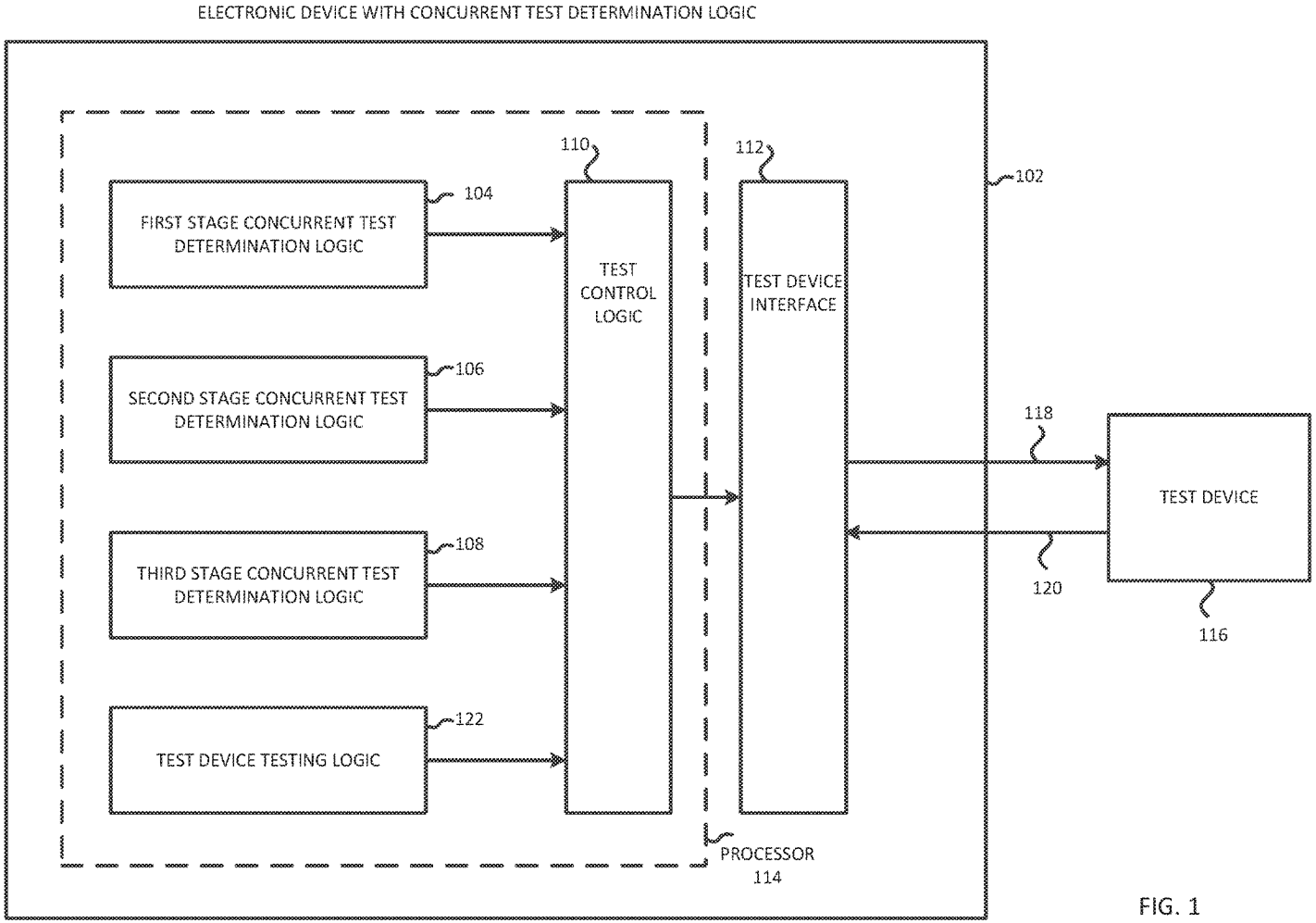
FIG. 1 is an example functional block diagram of an electronic device with concurrent test determination logic that includes first, second, and third stage concurrent test determination logic according to one example of the present disclosure.

FIG. 1 shows an example block diagram of an example electronic device with concurrent test determination logic ("electronic device") 102 that includes first stage concurrent test determination logic 104, second stage concurrent test determination logic 106, and third stage concurrent test determination logic 108. Although three stages of concurrent test determination logic are shown, it is to be appreciated that electronic device 102 may include less, or more, stages of concurrent test determination logic. Electronic device 102 also includes test control logic 110, test device interface 112, and test device testing logic 122. In some examples, electronic device 102 may be a personal computer, laptop, tablet, work station, or any other suitable electronic device. In some embodiments, some or all of the functionality of first stage concurrent test determination logic 104, second stage concurrent test determination logic 106, third stage concurrent test determination logic 108, test control logic 110, and test device testing logic 122 may be performed by one or more processors executing suitable instructions, such as processor 114 indicated in the figure. The processor may be any suitable processor, such as a central processing unit (CPU), digital signal processor (DSP), microprocessor, or any other suitable processor(s).

As indicated in the figure, electronic device 102 may be operably coupled to test device 116, where test device 116 is a device under test, such as a missile. Test device interface 112 of electronic device 102 may be configured to provide test signals 118 to test device 116. Test initiation signals 118 may include, for example, test preparation signals to prepare a test to be executed on test device 116. Test initiation signals 118 may also include signals to begin test execution on test device 116. Test device interface 112 may also be configured to receive test status signals 120. Test status signals 120 may include signals that provide information as to the current status of a test. Test status signals 120 may also indicate whether a particular test has completed, and whether the test was successful, or failed. Test initiation signals 118 and test status signals 120 may include, for example, analog signals, digital signals, control signals, or any other suitable signal.

As shown in the figure, test control logic 110 is operably coupled to test device interface 112. As such, test control logic 110 may be configured to provide (e.g., signal) information to test device interface 112 so as to cause test device interface 112 to provide one or more signals to test device 116 via test initiation signals 118. Similarly, test control logic 110 may be configured to receive (e.g., read) information from test device interface 112, such as information related to signals received by test device interface 112 from test device 116 via test status signals 120. Test control logic 110 is also operably coupled to test device testing logic 122. Test device testing logic 122, as described further below with respect to FIGS. 2-4, includes test logic to execute one or more tests on test device 116. Test control logic 110 is also operably coupled to first stage concurrent test determination logic 104, second stage concurrent test determination logic 106, and third stage concurrent test determination logic 108.

First stage concurrent test determination logic 104 is operable to determine that one or more first stage tests to be executed on test device 116, which may be executed by test device testing logic 122, do not require a missile target or high pressure gas for testing of the test device 116. For example, each test may have an associated setting, such as in memory (e.g., in a database, in a look up table), indicating whether that test requires a missile target or high pressure gas during its execution. First stage concurrent test determination logic 104 is operable to read the test settings and determine which test may be executed concurrently as first stage tests. First stage concurrent test determination logic 104 is also operable to concurrently execute (or cause to execute) the first stage tests on test device 116. For example, first stage concurrent test determination logic 104 may provide data, such as in a message, to test control logic 110, to cause test device interface 112 to provide test initiation signals 118 to test device 116 to prepare for execution, and execute, first stage tests to be executed on test device 116.

First stage concurrent test determination logic 104 is also operable to receive an indication of whether one or more first stage tests completed successfully. For example, first stage concurrent test determination logic 104 may receive data, such as in a message, from test control logic 110, indicating whether one or more first stage tests completed successfully. In one example, to determine whether a first stage test completed successfully, first stage concurrent test determination logic 104 provides data to test control logic 110 to cause test device interface 112 to receive test status signals 120 from test device 116. Test control logic 110 may then read data received via test status signals 120 and provide the data to first stage concurrent test determination logic 104 via, for example, a message. First stage concurrent test determination logic 104 is also operable to provide an indication of whether the first stage tests completed successfully, such as by providing for display the indication.

Second stage concurrent test determination logic 106 is operable to determine that one or more second stage tests to be executed on test missile 116, which may be executed by test device testing logic 122, require a first type (e.g., particular) missile target and high pressure gas for testing of the test device 116. For example, each test may have a setting, such as in memory, indicating whether that test requires a first type missile target and high pressure gas during its execution. Second stage concurrent test determination logic 106 is operable to read the test settings and determine which test may be executed concurrently as second stage tests. Second stage concurrent test determination logic 106 is also operable to concurrently execute (or cause to execute) the second stage tests on test device 116, similar to that described above with respect to first stage concurrent test determination logic 104.

Second stage concurrent test determination logic 106 is also operable to receive an indication of whether one or more second stage tests completed successfully, similar to that described above with respect to first stage concurrent test determination logic 104. Second stage concurrent test determination logic 106 is also operable to provide an indication of whether the second stage tests completed successfully, such as by providing for display the indication.

Third stage concurrent test determination logic 108 is operable to determine that one or more third stage tests to be executed on test missile 116, which may be executed by test device testing logic 122, require a second type missile target for testing of the test device 116. For example, each test may have a setting, such as in memory, indicating whether that test requires a second type missile target during its execution. Third stage concurrent test determination logic 108 is operable to read the test settings and determine which test may be executed concurrently as third stage tests. Third stage concurrent test determination logic 108 is also operable to concurrently execute (or cause to execute) the third stage tests on test device 116, similar to that described above with respect to first stage concurrent test determination logic 104 and second stage concurrent test determination logic 106.

Third stage concurrent test determination logic 108 is also operable to receive an indication of whether one or more second stage tests completed successfully, similar to that described above with respect to first stage concurrent test determination logic 104 and second stage concurrent test determination logic 106. Third stage concurrent test determination logic 108 is also operable to provide an indication of whether the third stage tests completed successfully, such as by providing for display the indication.

In one example, electronic device 102 is operable to enable first stage concurrent test determination logic 104 to execute first stage tests. Once the first stage tests are completed, electronic device 102 enables second stage concurrent test determination logic 106 to execute second stage tests. Once the second stage tests are completed, electronic device 102 enables third stage concurrent test determination logic 108 to execute third stage tests.

Figure 2:
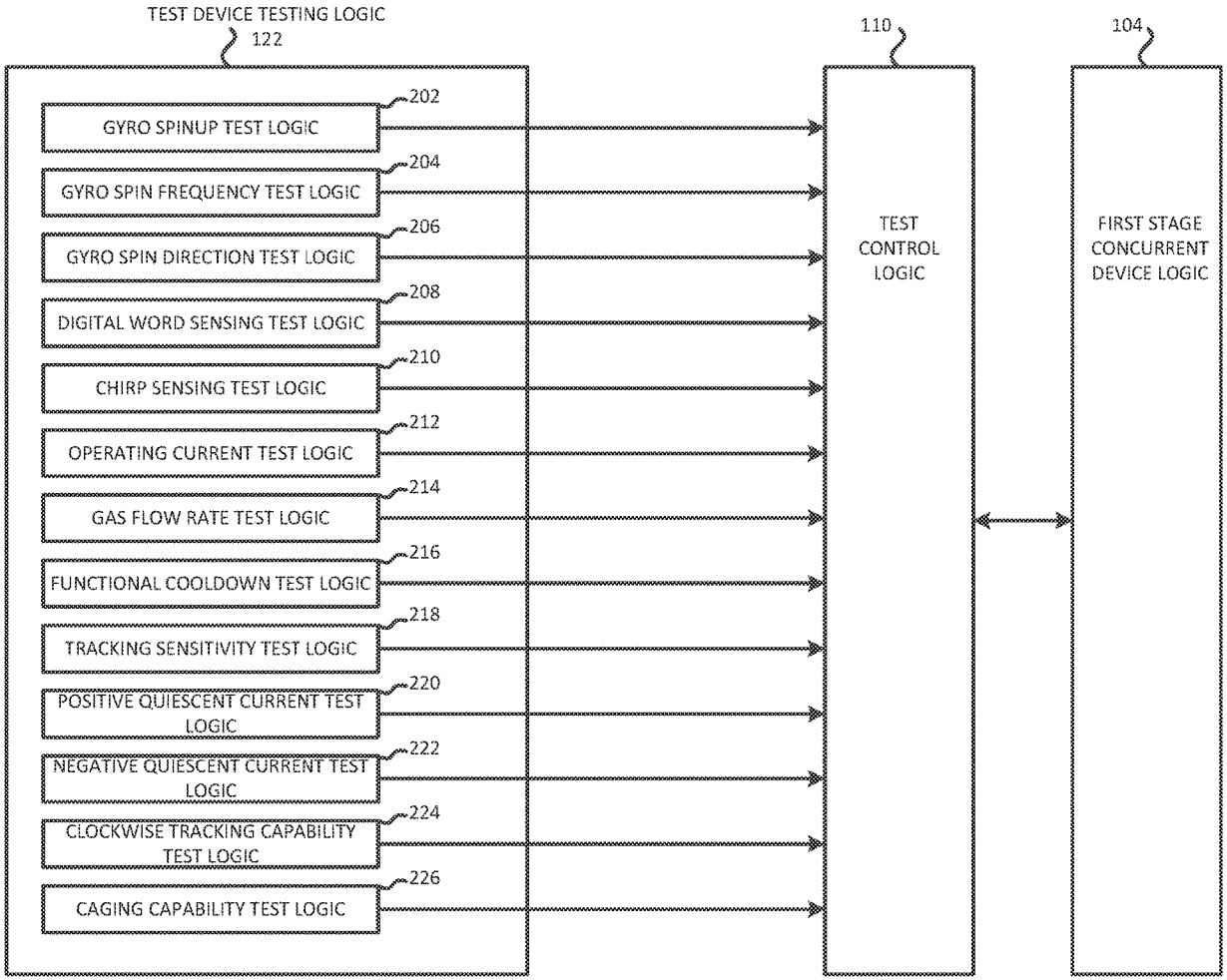
FIG. 2 is another functional block diagram with a more detailed view of the example test device testing logic 122, and its operability with test control logic 110 and first stage concurrent test determination logic, of FIG. 1 in accordance with one example of the present disclosure.

FIG. 2 shows a functional block diagram with a more detailed view of the test device testing logic 122, and its operability with test control logic 110 and first stage concurrent test determination logic 104, of FIG. 1. As indicated in the figure, test device testing logic 122 includes a plurality of test logic (202, 204, 206, 208, 210, 212, 214, 216, 218, 220, 222, 224, and 226) for executing (e.g., conducting) a plurality of tests, such as the various tests described above. For example, gyro spin test logic 202 is operable to execute a gyro spin test, while gyro spin frequency test logic 204 is operable to execute a gyro spin frequency test. Similarly, gyro spin direction test logic 206 is operable to execute a gyro spin direction test. Digital word sensing test logic 208 is operable to execute a digital word sensing test. Chirp test logic 210 is operable to execute a chirp test. Operating current test logic 212 is operable to execute an operating current test. Gas flow rate test logic 214 is operable to execute a gas flow rate test, while functional cool down test logic 216 is operable to execute a functional cool down test. Tracking sensitivity test logic 218 is operable to execute a tracking sensitivity test. Positive quiescent current test logic 220 is operable to execute a positive quiescent current test, while negative quiescent current test logic 222 is operable to execute a negative quiescent current test. Clockwise tracking capability test logic 224 is operable to execute a clockwise tracking capability test, and caging capability test logic 226 is operable to execute a caging capability test.

As described above with respect to FIG. 1, first stage concurrent test determination logic 104 is operable to determine that one or more first stage tests to be executed on test device 116, which may be executed by test device testing logic 122, do not require a missile target or high pressure gas for testing of the test device 116. For example, first stage concurrent test determination logic 104 may be operable to select which tests supported by test device testing logic 122 do not require a missile target or high pressure gas for testing of the test device 116. Test control logic 110 is operable to allow the selected tests to execute concurrently as first stage tests. For example, test control logic 110 may enable the selected tests, while disabling the others, to execute as first stage tests. In one example, test control logic 110 includes register settings whereby first stage concurrent test determination logic 104 is operable to enable or disable one or more of the a plurality of test logic (202, 204, 206, 208, 210, 212, 214, 216, 218, 220, 222, 224, and 226) supported by test device testing logic 122.

Figure 3:
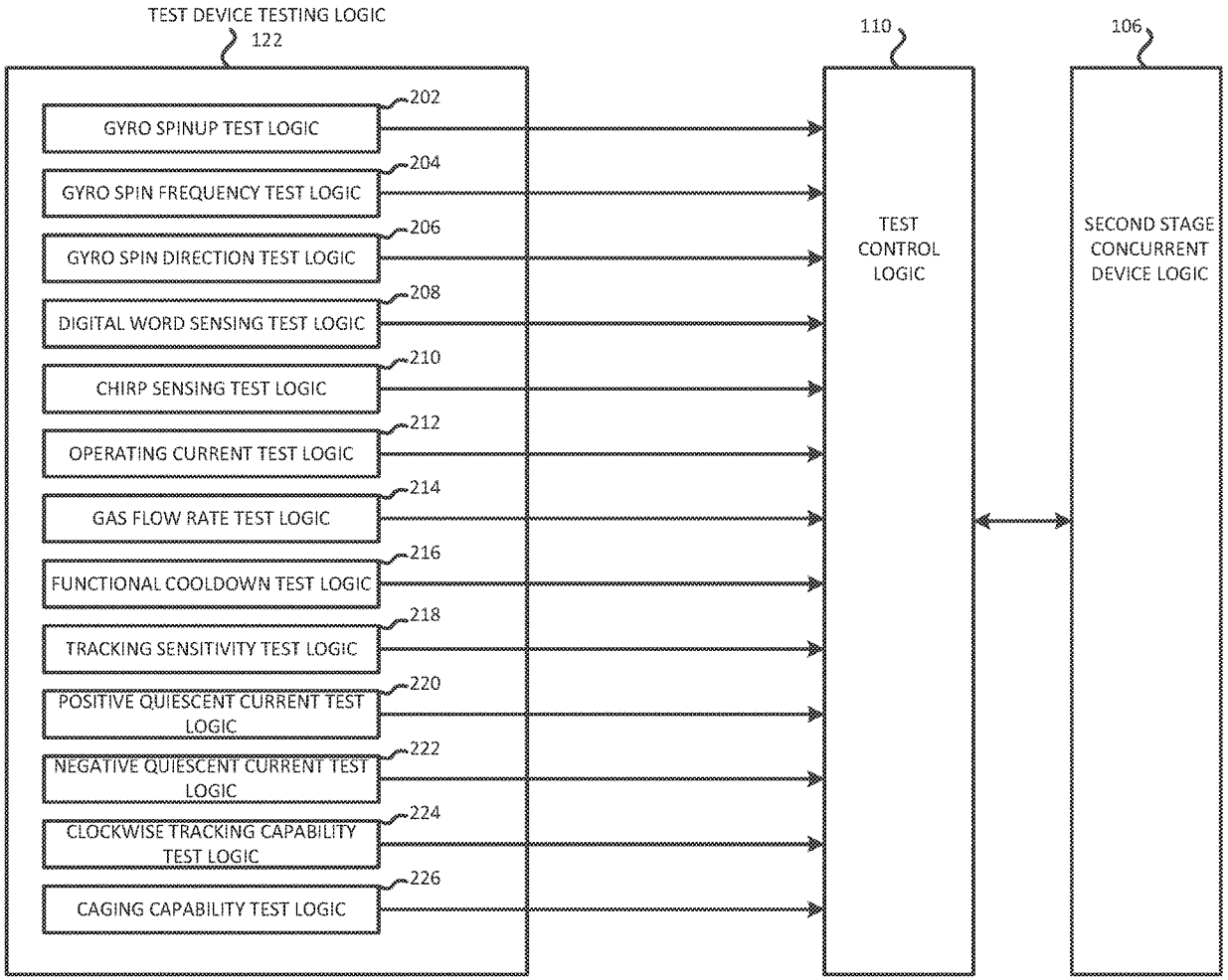
FIG. 3 is another functional block diagram with a more detailed view of the example test device testing logic 122, and its operability with test control logic 110 and second stage concurrent test determination logic, of FIG. 1 in accordance with one example of the present disclosure.

FIG. 3 shows a functional block diagram with a more detailed view of the test device testing logic 122, and its operability with test control logic 110 and second stage concurrent test determination logic 106, of FIG. 1. As described above with respect to FIG. 1, second stage concurrent test determination logic 106 is operable to determine that one or more second stage tests to be executed on test device 116, which may be executed by test device testing logic 122, require a first type missile target and high pressure gas for testing of the test device 116. Similar to that described above with respect to first stage concurrent test determination logic 104 in FIG. 2, second stage concurrent test determination logic 106 may be operable to select which tests supported by test device testing logic 122 require a first type missile target and high pressure gas for testing of the test device 116. Test control logic 110 is operable to allow the selected tests to execute concurrently as second stage tests.

Figure 4:
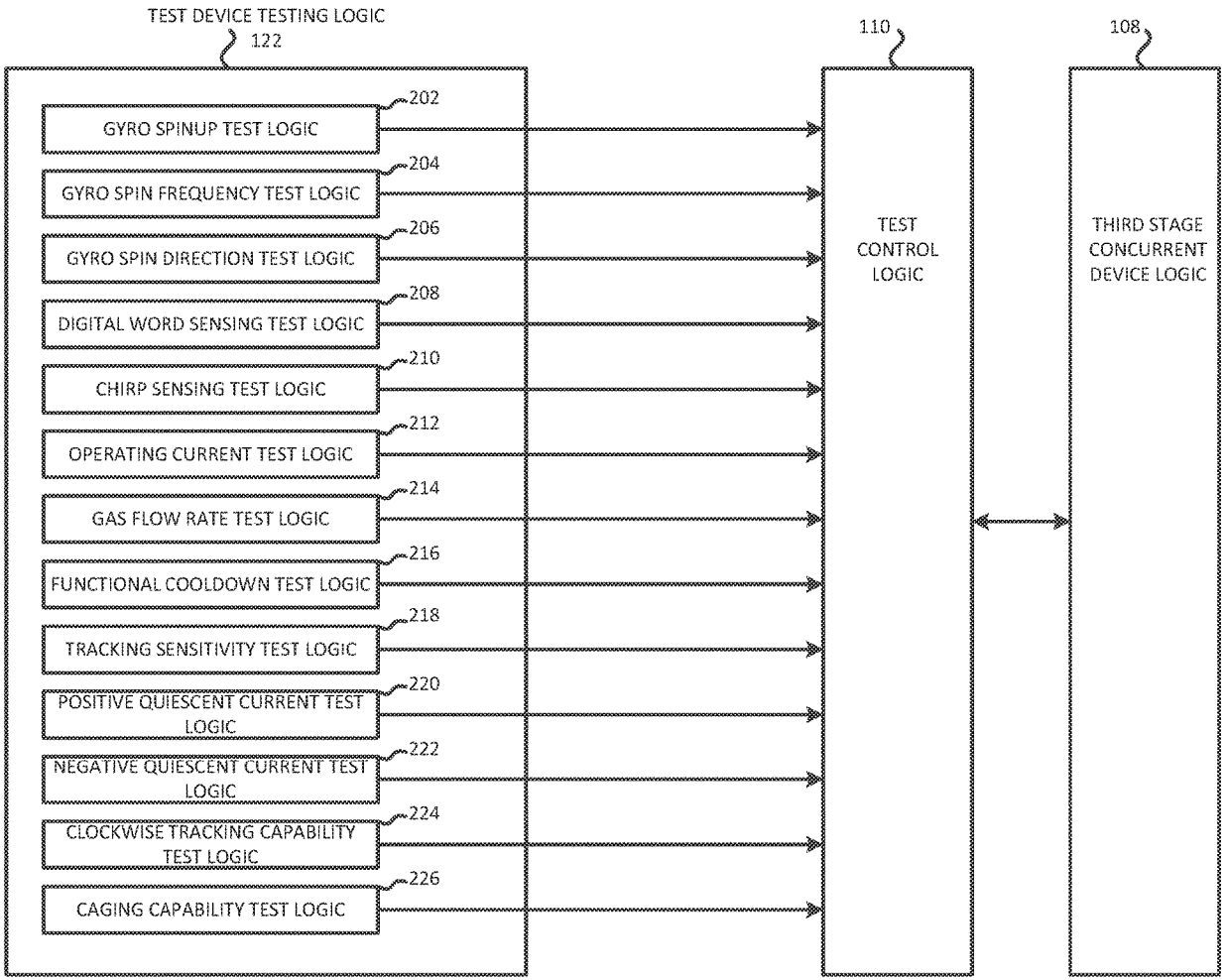
FIG. 4 is another functional block diagram with a more detailed view of the example test device testing logic 122, and its operability with test control logic 110 and third stage concurrent test determination logic, of FIG. 1 in accordance with one example of the present disclosure.

FIG. 4 shows a functional block diagram with a more detailed view of the test device testing logic 122, and its operability with test control logic 110 and third stage concurrent test determination logic 108, of FIG. 1. As described above with respect to FIG. 1, third stage concurrent test determination logic 106 is operable to determine that one or more third stage tests to be executed on test device 116, which may be executed by test device testing logic 122, require a second type missile target for testing of the test device 116. Similar to that described above with respect to first stage concurrent test determination logic 104 in FIG. 2, third stage concurrent test determination logic 108 may be operable to select which tests supported by test device testing logic 122 require a second type missile target for testing of the test device 116. Test control logic 110 is operable to allow the selected tests to execute concurrently as third stage tests.

Figure 5:
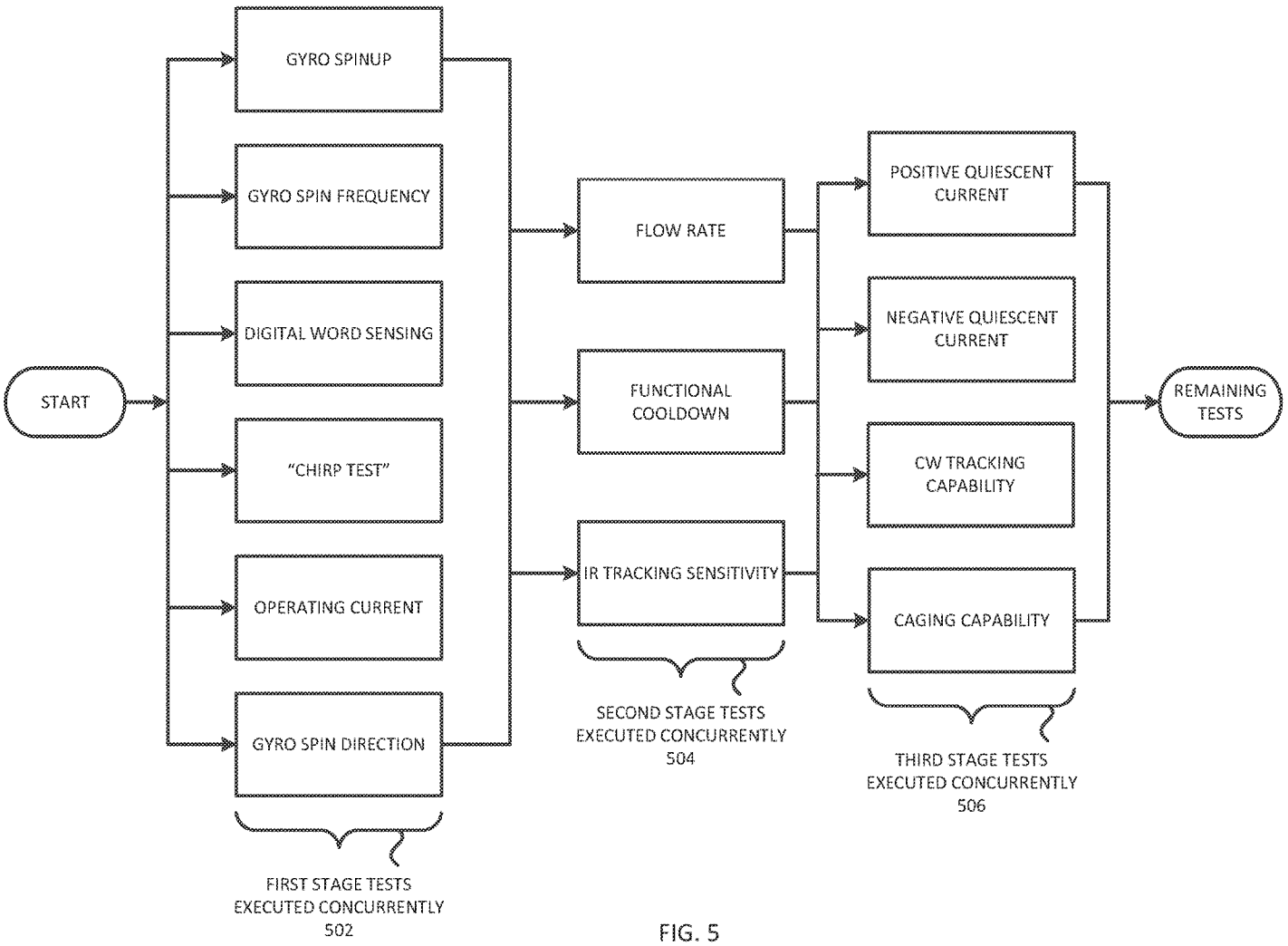
FIG. 5 is an example diagram indicating various test that may be performed concurrently by, for example, the electronic device of FIG. 1 in accordance with one example of the present disclosure.

FIG. 5 is a diagram indicating example tests that may be performed concurrently on a test device by, for example, the electronic device 102 of FIG. 1. For example, first stage tests 502 may be executed concurrently, which may include a gyro spin test, a gyro spin frequency test, a digital word sensing test, a chirp test, an operating current test, and a gyro spin direction test. Second stage tests 504 may also be executed concurrently, which may include a gas flow rate test, a functional cool down test, and a tracking sensitivity test. Likewise, third stage tests 506 may be executed concurrently, which may include a positive quiescent current test, a negative quiescent current test, a clockwise tracking capability test, and a caging capability test. In one example, first stage tests 502 are executed and, once complete, second stage tests 504 are executed. Once the second stage tests 504 are complete, third stage tests 504 are executed. Once the third stage tests are complete, any other tests may then be executed.

Figure 6:
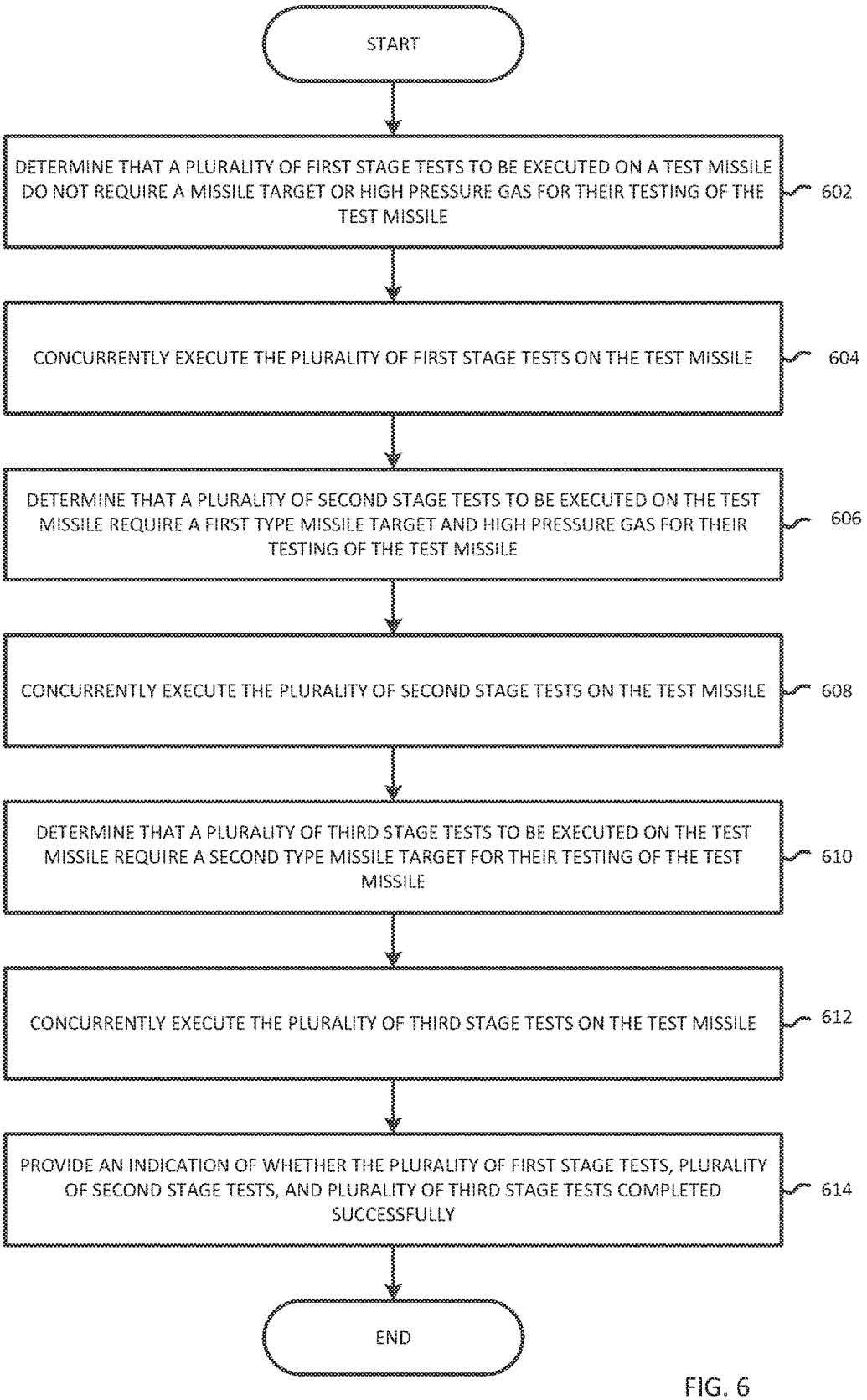
FIG. 6 is a flowchart of an example method for concurrently executing a plurality of first, second, and third stage tests as may be performed by, for example, the electronic device of FIG. 1 in accordance with one example of the present disclosure.

FIG. 6 illustrates an exemplary method 600 that may be realized, for example, by electronic device 102. For example, all or parts of method 600 may be performed by a software algorithm, such as one executed by electronic device 102. In various embodiments of the present disclosure, the steps or processes involved in method 600, and any other methods described herein, should not be limited to the sequence described in the present disclosure. One of ordinary skill in the art could readily understand the plurality of different options for organizing or executing the steps of the methods described herein in order to achieve substantially the same results or outcomes disclosed herein. Accordingly, the present disclosure contemplates that one of ordinary skill in the art may implement or execute one or more steps of the methods described herein in a plurality of different ways. Thus, the present disclosure should not be limited to the particular order disclosed in the methods described herein.

Method 600 begins at step 602, where a determination is made that a plurality of first stage tests to be executed on a test missile do not require a missile target or high pressure gas for testing of the test missile. At step 604, the plurality of first stage tests are concurrently executed on the test missile. At step 606, a determination is made that a plurality of second stage tests to be executed on the test missile require a first type missile target and high pressure gas for testing of the test missile. At step 608, the plurality of second stage tests are concurrently executed on the test missile. Proceeding to step 610, a determination is made that a plurality of third stage tests to be executed on the test missile require a second type missile target for testing of the test missile. At step 612, the plurality of third stage tests are concurrently executed on the test missile. At step 614 an indication of whether the plurality of first stage tests, plurality of second stage tests, and plurality of third stage tests were completed successfully is provided.

Figure 7:
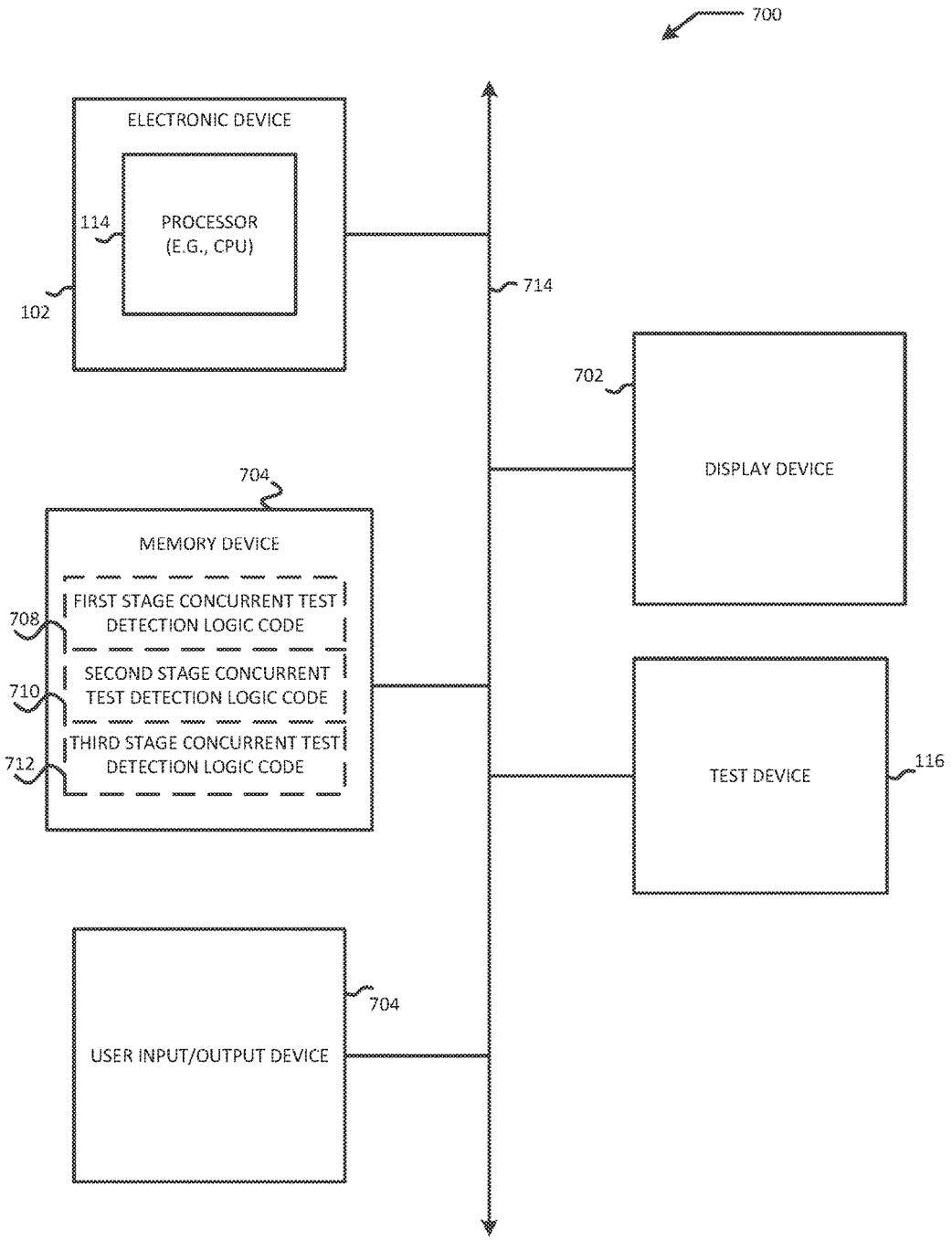
FIG. 7 is an example functional block diagram of a device testing system that includes an electronic device, a display device, a user input device, a test device, and first, second, and third stage concurrent test determination logic code residing in memory in accordance with one example of the present disclosure.

FIG. 7 is a functional block diagram illustrating an example device testing system 700 employing an electronic devices with processor 114 and test device 116. Device testing system 700 also includes display device 702, user Input/Output device 706, and memory device 704. Each of these devices is operatively coupled to expansion bus XXX. Display device 702 may be any suitable display device, such as a monitor, a liquid crystal display (LCD), a touch screen, or any other suitable display. User Input/Output device 706 may be any suitable input/output device such as a keyboard, a stylus, a touch screen, or any other suitable input/output device.

In some examples, executable suitable instructions may be stored on a computer readable storage medium, where the executable instructions are executable by one or more processors to cause the one or more processors to perform the actions described herein. Referring back to FIG. 7, memory device 704 may store executable instructions, including first stage concurrent test determination logic code 708, second stage concurrent test determination logic code 710, and third stage concurrent test determination logic 712, each of which may be executed by processor 114. For example, first stage concurrent test determination logic code 708 may include, for example, executable instructions corresponding to (e.g., compiled from) the "TestPhaseI" code module included in the code listing attached as an appendix. The appendix is incorporated by reference herein. Similarly, second stage concurrent test determination logic code 710 may include, for example, executable instructions corresponding to the "TestPhaseII" code module included in the code listing, and third stage concurrent test determination logic 712 may include executable instructions corresponding to the "TestPhaseIII" code module included in the code listing.

As indicated in the figure, electronic device 102 is operatively coupled to memory device 704 via expansion bus 714 such that processor 114 may obtain first stage concurrent test determination logic code 708 from memory device 704 for execution. Similarly, processor 114 may obtain second stage concurrent test determination logic code 710 and third stage concurrent test determination logic code 712 from memory device 704 for execution. Memory device 704 may be any suitable memory, such as random access memory (RAM), non-volatile memory (e.g., read-only memory (ROM), flash memory, EPROM, EEPROM, etc.), a disk storage device, or any other suitable memory that may store executable instructions.

Some or all of the functionality described above may be implemented in hardware or a combination of hardware and hardware executing suitable instructions. Suitable hardware may include one or more processors, ASICs, state machines, FPGAs, or other suitable hardware. Some or all of the functionality described above may also be implemented in any other suitable manner such as, but not limited to, a software implementation including, for example, a driver implementation, a firmware implementation, a hardware implementation, or any suitable combination of the example implementations described above. In some examples, the executable suitable instructions may be stored on a computer readable storage medium, where the executable instructions are executable by one or more processors to cause the one or more processors to perform the actions described herein. Computer readable storage medium may include, for example, flash memory, any non-transitory computer readable medium such as but not limited to RAM or ROM, a cloud storage mechanism, or any other suitable storage mechanism.

In the foregoing specification, specific embodiments of the present disclosure have been described. However, one of ordinary skill in the art will appreciate that various modifications and changes can be made without departing from the scope of the disclosure as set forth in the claims below. Accordingly, the specification and figures are to be regarded in an illustrative, rather than a restrictive, sense, and all such modifications are intended to be included within the scope of disclosure. The benefits, advantages, solutions to problems, and any element(s) that may cause any benefit, advantage, or solution to occur or become more pronounced are not to be construed as critical, required, or essential features or elements of any or all the claims. The disclosure is defined solely by the appended claims including any amendments made during the pendently of this application and all equivalents of those claims as issued. Although the invention has been described in detail with reference to certain embodiments, variations and modifications exist within the spirit and scope of the disclosures as described and defined in the following claims.

The invention claimed is:

1. A test system comprising:

a test missile;

an electronic device operably coupled to the test missile and comprising:

first stage concurrent determination test logic configured to:

determine that a plurality of first stage tests to be executed on the test missile do not require a missile target or high pressure gas for testing of the test missile;

concurrently execute the plurality of first stage tests on the test missile by determining when data will be made available for each of the plurality of first stage tests and executing a portion of the plurality of first stage tests that may be completed before the data is made available for each of the plurality of first stage tests; and provide an indication of whether the plurality of first stage tests completed successfully;

second stage concurrent determination test logic configured to:

determine that a plurality of second stage tests to be executed on the test missile require a first type missile target and high pressure gas for testing of the test missile;

concurrently execute the plurality of second stage tests on the test missile by determining when data will be made available for each of the plurality of second stage tests and executing a portion of the plurality of second stage tests that may be completed before the data is made available for each of the plurality of second stage tests; and provide an indication of whether the plurality of second stage tests completed successfully; and third stage concurrent determination test logic configured to:

determine that a plurality of third stage tests to be executed on the test missile require a second type missile target for testing of the test missile;

concurrently execute the plurality of third stage tests on the test missile by determining when data will be made available for each of the plurality of third stage tests and executing a portion of the plurality of third stage tests that may be completed before the data is made available for each of the plurality of third stage tests; and provide an indication of whether the plurality of third stage tests completed successfully.

2. The test system of claim 1 wherein the electronic device comprises gyro spin test logic for executing a gyro spin test, wherein the plurality of first stage tests comprise the gyro spin test, wherein the gyro spin test logic is operable to:

provide the test missile with a first test signal;

determine a gyro spin frequency of a gyro of the test missile based on a first received signal from the test missile after a first minimum threshold amount of time;

determine a gyro spin time of the gyro of the test missile based on the first received signal from the test missile; and determine whether the determined gyro spin frequency is within a gyro spin frequency range and whether the determined gyro spin time falls within a gyro spin time range, wherein:

if the determined gyro spin frequency is within the gyro spin frequency range and the determined gyro spin time is within the gyro spin time range, the gyro spin test logic provides an indication that the gyro spin test completed successfully; and if the determined gyro spin frequency is not within the gyro spin frequency range or the determined gyro spin time is not within the gyro spin time range, the gyro spin test logic provides an indication that the gyro spin test has failed.

3. The test system of claim 2 wherein the electronic device comprises gyro spin frequency test logic for executing a gyro spin frequency test, wherein the plurality of first stage tests comprise the gyro spin frequency test, wherein the gyro spin frequency test logic is operable to:

determine a gyro spin frequency of the gyro of the test missile based on a second received signal from the test missile after a second minimum threshold amount of time; and determine whether the determined gyro spin frequency is within a gyro spin frequency range, wherein:

if the determined gyro spin frequency is within the gyro spin frequency range, the gyro spin frequency test logic provides an indication that the gyro spin frequency test completed successfully; and if the determined gyro spin frequency is not within the gyro spin frequency range, the gyro spin frequency test logic provides an indication that the gyro spin frequency test has failed.

4. The test system of claim 3 wherein the electronic device comprises gyro spin direction test logic for executing a gyro spin direction test, wherein the plurality of first stage tests comprise the gyro spin direction test, wherein the gyro spin direction test logic is operable to determine a gyro spin direction of the gyro of the test missile.

5. The test system of claim 1 wherein the electronic device comprises digital word sensing test logic for executing a digital word sensing test, wherein the plurality of first stage tests comprise the digital word sensing test, wherein the digital word sensing test logic is operable to:

determine whether a digital word in signal occurred based on a first received signal from the test missile after a minimum threshold amount of time;

determine whether a digital word out signal occurred based on a second received signal from the test missile after the minimum threshold amount of time; wherein:

if the digital word in signal occurred and the digital word out signal occurred, the digital word sensing test logic provides an indication that the digital word sensing test completed successfully; and otherwise the digital word sensing test logic provides an indication that the digital word sensing test has failed.

6. The test system of claim 1 wherein the electronic device comprises chirp test logic for executing a chirp test, wherein the plurality of first stage tests comprise the chirp test, wherein the chirp test logic is operable to:

periodically determine an audio out signal level based on a received audio out signal from the test missile over a period of time; and determine a number of times that the measured audio out signal level exceeds an audio out signal level threshold, wherein:

if the determined number of times that the measured audio out signal level exceeds the audio out signal level threshold is greater than a maximum threshold, the audio out signal level test logic provides an indication that the audio out signal level test failed; and otherwise the audio out signal level test logic provides an indication that the audio out signal level test completed successfully.

7. The test system of claim 1 wherein the electronic device comprises operating current test logic for executing an operating current test, wherein the plurality of first stage tests comprise the operating current test, wherein the operating current test logic is operable to:

determine an operating current based on a received signal from the test missile;

determine whether the operating current is within an operating current range; and determine a number of how many of the plurality of first stage tests are completed, wherein:

if the operating current is not within the operating current range or a determined number of the plurality of first stage tests are not completed, the operating current test logic provides an indication that the operating current test has failed; and if the operating current is within the operating current range and the determined number of the plurality of first stage tests are completed, the operating current test logic provides an indication that the operating current test completed successfully.

8. The test system of claim 1 wherein the electronic device comprises gas flow rate test logic for executing a gas flow rate test, wherein the plurality of second stage tests comprise the gas flow rate test, wherein the gas flow rate test logic is operable to:

determine a gas flow rate based on one or more received signals from the test missile after a minimum threshold amount of time; and determine whether the gas flow rate is within a gas flow rate range, wherein:

if the gas flow rate is within the gas flow rate range, the gas flow rate test logic provides an indication that the gas flow rate test completed successfully; and otherwise the gas flow rate test logic provides an indication that the gas flow rate test has failed.

9. The test system of claim 1 wherein the electronic device comprises functional cool down test logic for executing a functional cooldown test, wherein the plurality of second stage tests comprise the functional cooldown test, wherein the functional cooldown test logic is operable to determine whether the test missile acquires tracking of the first type missile target before a maximum threshold amount of time has expired based on a first received signal from the test missile, wherein:

if the test missile acquires tracking of the first type missile target before the maximum threshold amount of time expires, the functional cooldown test logic provides an indication that the functional cooldown test completed successfully; and otherwise the functional cooldown test logic provides an indication that the functional cool down test has failed.

10. The test system of claim 9 wherein the electronic device comprises tracking sensitivity test logic for executing a tracking sensitivity test, wherein the plurality of second stage tests comprise the tracking sensitivity test, wherein the tracking sensitivity test logic is operable to determine whether the test missile maintains acquisition of the first type missile target for a minimum threshold amount of time based on a second received signal from the test missile, wherein:

if the test missile maintains acquisition of the first type missile target for the minimum threshold amount of time, the tracking sensitivity test logic provides an indication that the tracking sensitivity test completed successfully; and otherwise the tracking sensitivity test logic provides an indication that the tracking sensitivity test has failed.

11. The test system of claim 1 wherein the electronic device comprises positive quiescent current test logic for executing a positive quiescent current test, wherein the plurality of third stage tests comprise the positive quiescent current test, wherein the positive quiescent current test logic is operable to determine a positive quiescent current level of the test missile while the test missile is tracking the second missile type target based on a received signal from the test missile, wherein:

if the positive quiescent current level is within a positive quiescent current range, the positive quiescent current test logic provides an indication that the positive quiescent current test completed successfully; and otherwise the positive quiescent current test logic provides an indication that the positive quiescent current test has failed.

12. The test system of claim 1 wherein the electronic device comprises negative quiescent current test logic for executing a negative quiescent current test, wherein the plurality of third stage tests comprise the negative quiescent current test, wherein the negative quiescent current test logic is operable to determine a negative quiescent current level of the test missile while the test missile is tracking the second missile type target based on a received signal from the test missile, wherein:

if the negative quiescent current level is within a negative quiescent current range, the negative quiescent current test logic provides an indication that the negative quiescent current test completed successfully; and otherwise the negative quiescent current test logic provides an indication that the negative quiescent current test has failed.

13. The test system of claim 1 wherein the electronic device comprises clockwise tracking capability test logic for executing a clockwise tracking capability test, wherein the plurality of third stage tests comprise the clockwise tracking capability test, wherein the clockwise tracking capability test logic is operable to determine whether the test missile maintains acquisition of the second type missile target for a minimum threshold amount of time based on a received signal from the test missile, wherein:

if the test missile maintains acquisition of the second type missile target for the minimum threshold amount of time, the clockwise tracking capability test logic provides an indication that the clockwise tracking capability test completed successfully; and otherwise the clockwise tracking capability test logic provides an indication that the clockwise tracking capability test has failed.

14. The test system of claim 1 wherein the electronic device comprises caging capability test logic for executing a caging capability test, wherein the plurality of third stage tests comprise the caging capability test, wherein the caging capability test logic is operable to:

provide an indication to the test missile to cease tracking the second missile target type and return to an off-axis position;

determine, based on one or more received signals from the test missile, whether the test missile loses acquisition of the second missile target type and returns to an off-axis position, wherein:

if the test missile loses acquisition of the second missile target type and returns to an off-axis position, the caging capability test logic provides an indication that the caging capability test completed successfully; and otherwise the caging capability test logic provides an indication that the caging capability test has failed.

15. A method in an electronic device comprising:

determining that a plurality of first stage tests to be executed on a test missile do not require a missile target or high pressure gas for testing of the test missile;

concurrently executing the plurality of first stage tests on the test missile by determining when data will be made available for each of the plurality of first stage tests and executing a portion of the plurality of first stage tests that may be completed before the data is made available for each of the plurality of first stage tests;

determining that a plurality of second stage tests to be executed on the test missile require a first type missile target and high pressure gas for testing of the test missile;

concurrently executing the plurality of second stage tests on the test missile by determining when data will be made available for each of the plurality of second stage tests and executing a portion of the plurality of second stage tests that may be completed before the data is made available for each of the plurality of second stage tests;

determining that a plurality of third stage tests to be executed on the test missile require a second type missile target for testing of the test missile; and concurrently executing the plurality of third stage tests on the test missile by determining when data will be made available for each of the plurality of third stage tests and executing a portion of the plurality of third stage tests that may be completed before the data is made available for each of the plurality of third stage tests; and providing an indication of whether the plurality of first stage tests, plurality of second stage tests, and plurality of third stage tests completed successfully.

16. The method of claim 15 wherein concurrently executing the plurality of first stage tests on the test missile comprises:

providing the test missile with a first test signal;

determining a gyro spin frequency of a gyro of the test missile based on a first received signal from the test missile after a first minimum threshold amount of time;

determining a gyro spin time of the gyro of the test missile based on the first received signal from the test missile; and determining whether the determined gyro spin frequency is within a gyro spin frequency range and whether the determined gyro spin time falls within a gyro spin time range, wherein:

if the determined gyro spin frequency is within the gyro spin frequency range and the determined gyro spin time is within the gyro spin time range, providing an indication that a gyro spin test completed successfully; and if the determined gyro spin frequency is not within the gyro spin frequency range or the determined gyro spin time is not within the gyro spin time range providing an indication that the gyro spin test has failed.

17. The method of claim 16 wherein concurrently executing the plurality of first stage tests on the test missile comprises:

determining a gyro spin frequency of the gyro of the test missile based on a second received signal from the test missile after a second minimum threshold amount of time; and determining whether the determined gyro spin frequency is within a gyro spin frequency range, wherein:

if the determined gyro spin frequency is within the gyro spin frequency range, providing an indication that a gyro spin frequency test completed successfully; and if the determined gyro spin frequency is not within the gyro spin frequency range, providing an indication that the gyro spin frequency test has failed.

18. The method of claim 17 wherein concurrently executing the plurality of first stage tests on the test missile comprises determining a gyro spin direction of the gyro of the test missile.

19. The method of claim 15 wherein concurrently executing the plurality of first stage tests on the test missile comprises:

determining whether a digital word in signal occurred based on a first received signal from the test missile after a minimum threshold amount of time;

determining whether a digital word out signal occurred based on a second received signal from the test missile after the minimum threshold amount of time; wherein:

if the digital word in signal occurred and the digital word out signal occurred, providing an indication that the digital word sensing test completed successfully; and otherwise providing an indication that the digital word sensing test has failed.

20. The method of claim 15 wherein concurrently executing the plurality of first stage tests on the test missile comprises:

periodically determining an audio out signal level based on a received audio out signal from the test missile over a period of time; and determining a number of times that the measured audio out signal level exceeds an audio out signal level threshold, wherein:

if the number of times that the measured audio out signal level exceeds the audio out signal level threshold is greater than a maximum threshold, providing an indication that an audio out signal level test completed successfully; and otherwise providing an indication that the audio out signal level test has failed.

21. The method of claim 15 wherein concurrently executing the plurality of first stage tests on the test missile comprises:

determining an operating current based on a received signal from the test missile after a minimum threshold amount of time;

determining whether the operating current is within an operating current range; and determining a number of how many of the plurality of first stage tests are completed, wherein:

if the operating current is not within the operating current range or a determined number of the plurality of fist stage tests are not completed, providing an indication that an operating current test has failed; and if the operating current is within the operating current range and the determined number of the plurality of first stage tests are completed, providing an indication that the operating current test completed successfully.

22. The method of claim 15 wherein concurrently executing the plurality of second stage tests on the test missile comprises:

determining a gas flow rate based on a received signal from the test missile after a minimum threshold amount of time; and determining whether the gas flow rate is within a gas flow rate range, wherein:

if the gas flow rate is within the gas flow rate range, providing an indication that a gas flow rate test completed successfully; and otherwise providing an indication that the gas flow rate test has failed.

23. The method of claim 15 wherein concurrently executing the plurality of second stage tests on the test missile comprises determining whether the test missile acquires tracking of the first type missile target before a maximum threshold amount of time based on a first received signal from the test missile, wherein:

if the test missile acquires tracking of the first type missile target before the maximum threshold amount of time, providing an indication that a functional cooldown test completed successfully; and otherwise providing an indication that the functional cooldown test has failed.

24. The method of claim 23 wherein concurrently executing the plurality of second stage tests on the test missile comprises determining whether the test missile maintains acquisition of the first type missile target for a minimum threshold amount of time based on a second received signal from the test missile, wherein:

if the test missile maintains acquisition of the first type missile target for the minimum threshold amount of time, providing an indication that a tracking sensitivity test completed successfully; and otherwise providing an indication that the tracking sensitivity test has failed.

25. The method of claim 15 wherein concurrently executing the plurality of third stage tests on the test missile comprises determining a positive quiescent current level of the test missile while the test missile is tracking the second missile type target based on a received signal from the test missile, wherein:

if the positive quiescent current level is within a positive quiescent current range, providing an indication that a positive quiescent current test completed successfully; and otherwise providing an indication that the positive quiescent current test has failed.

26. The method of claim 15 wherein concurrently executing the plurality of third stage tests on the test missile comprises determining a negative quiescent current level of the test missile while the test missile is tracking the second missile type target based on a received signal from the test missile, wherein:

if the negative quiescent current level is within a negative quiescent current range, providing an indication that the negative quiescent current test completed successfully; and otherwise providing an indication that the negative quiescent current test has failed.

27. The method of claim 15 wherein concurrently executing the plurality of third stage tests on the test missile comprises determining whether the test missile maintains acquisition of the second type missile target for a minimum threshold amount of time based on a received signal from the test missile, wherein:

if the test missile maintains acquisition of the second type missile target for the minimum threshold amount of time, providing an indication that a clockwise tracking capability test completed successfully; and otherwise providing an indication that the clockwise tracking capability test has failed.

28. The method of claim 15 wherein concurrently executing the plurality of third stage tests on the test missile comprises:

providing an indication to the test missile to cease tracking the second missile target type and return to an off-axis position; and determining, based on one or more received signals from the test missile, whether the test missile loses acquisition of the second missile target type and returns to an off-axis position, wherein:

if the test missile loses acquisition of the second missile target type and returns to an off-axis position, providing an indication that the caging capability test completed successfully; and otherwise providing an indication that the caging capability test has failed.

29. A test system comprising:

a device under test;

an electronic device operably coupled to the device under test and comprising:

first stage concurrent determination test logic configured to:

determine that a plurality of first stage tests to be executed on the device under test require a first test environment;

concurrently execute the plurality of first stage tests on the device under test by determining when data will be made available for each of the plurality of first stage tests and executing a portion of the plurality of first stage tests that may be completed before the data is made available for each of the plurality of first stage tests; and provide an indication of whether the plurality of first stage tests completed successfully;

second stage concurrent determination test logic configured to:

determine that a plurality of second stage tests to be executed on the device under test require a second test environment;

concurrently execute the plurality of second stage tests on the device under test by determining when data will be made available for each of the plurality of second stage tests and executing a portion of the plurality of second stage tests that may be completed before the data is made available for each of the plurality of second stage tests; and provide an indication of whether the plurality of second stage tests completed successfully; and third stage concurrent determination test logic configured to:

determine that a plurality of third stage tests to be executed on the device under test require a third test environment;

concurrently execute the plurality of third stage tests on the device under test by determining when data will be made available for each of the plurality of third stage tests and executing a portion of the plurality of third stage tests that may be completed before the data is made available for each of the plurality of third stage tests; and provide an indication of whether the plurality of third stage tests completed successfully.

30. The test system of claim 29 wherein the device under test is a missile, wherein the first test environment does not require a missile target or high pressure gas for the testing of the test missile, wherein the second test environment does require a first type missile target and high pressure gas for the testing of the test missile, and the third test environment requires a second type missile target for the testing of the test missile.

* * * * *